US010551779B2

(12) United States Patent
Shimohora

(10) Patent No.: US 10,551,779 B2
(45) Date of Patent: Feb. 4, 2020

(54) FIXING DEVICE INCLUDING PRESSING MECHANISM FOR PRESSING REGION AND IMAGE FORMING APPARATUS

(71) Applicant: KYOCERA Document Solutions Inc., Osaka (JP)

(72) Inventor: Yuya Shimohora, Osaka (JP)

(73) Assignee: KYOCERA Documents Solutions Inc., Osaka (JP)

( * ) Notice: Subject to any disclaimer, the term of this patent is extended or adjusted under 35 U.S.C. 154(b) by 0 days.

(21) Appl. No.: 16/391,357

(22) Filed: Apr. 23, 2019

(65) Prior Publication Data

US 2019/0332045 A1 Oct. 31, 2019

(30) Foreign Application Priority Data

Apr. 25, 2018 (JP) ..... 2018-084001

(51) Int. Cl.
*G03G 15/20* (2006.01)

(52) U.S. Cl.
CPC ..... *G03G 15/2064* (2013.01); *G03G 15/2017* (2013.01); *G03G 2215/2035* (2013.01)

(58) Field of Classification Search
CPC ..... G03G 15/2064; G03G 15/2017; G03G 15/2035
See application file for complete search history.

(56) References Cited

U.S. PATENT DOCUMENTS 8,010,017 B2 * 8/2011 Foster ..... G03G 15/2028 399/122
8,041,237 B2 * 10/2011 Yamanaka ..... G03G 15/2032 399/33
8,099,034 B2 * 1/2012 Tsukamoto ..... G03G 15/2032 399/320
8,190,060 B2 * 5/2012 Yoshinaga ..... G03G 15/2032 399/122
8,948,639 B2 * 2/2015 Kawakami ..... G03G 15/2032 399/67
2006/0147226 A1 * 7/2006 Sato ..... G03G 21/1633 399/122
2007/0019977 A1 * 1/2007 Sawamura ..... G03G 15/2064 399/67

(Continued)

FOREIGN PATENT DOCUMENTS

JP H10-123877 A 5/1998

*Primary Examiner* — G. M. A Hyder
(74) *Attorney, Agent, or Firm* — Studebaker & Brackett PC

(57) ABSTRACT

A fixing device includes a heating member, a pressing member, a pressing mechanism and a locking mechanism. The heating member is rotatable. The pressing roller is configured to come into contact with the heating member. The pressing mechanism is configured to convert a rotational force transmitted from a drive source to a pressing force of pressing the pressing roller against the heating member and to form a pressing region between the pressing roller and the heating member. A sheet is conveyed through the pressing region. The locking mechanism is configured to be engaged with an image forming apparatus main body linked with a pressing operation of applying the pressing force to the pressing roller and to be disengaged from the image forming apparatus main body linked with completion of a pressing release operation of removing the pressing force.

5 Claims, 12 Drawing Sheets

(56) References Cited

U.S. PATENT DOCUMENTS

| | | | | |
|---|---|---|---|---|
| 2008/0031647 | A1* | 2/2008 | Yoshikawa | G03G 15/2032 399/67 |
| 2008/0181686 | A1* | 7/2008 | Geyling | G03G 15/2032 399/329 |
| 2009/0148204 | A1* | 6/2009 | Yoshinaga | G03G 15/2035 399/328 |
| 2013/0071152 | A1* | 3/2013 | Fujiwara | G03G 15/2092 399/329 |

* cited by examiner

FIXING DEVICE INCLUDING PRESSING MECHANISM FOR PRESSING REGION AND IMAGE FORMING APPARATUS

INCORPORATION BY REFERENCE

This application is based on and claims the benefit of priority from Japanese patent application No. 2018-084001 filed on Apr. 25, 2018, which is incorporated by reference in its entirety.

BACKGROUND

The present disclosure relates to a fixing device and an image forming apparatus.

A general configuration of a fixing device that fixes a toner to a sheet is provided with a rotatable heating member (such as a fixing roller and a fixing belt), a pressing roller coming into contact with the heating member and a pressing mechanism that forms a pressing region in which the sheet is to be sandwiched and conveyed between the pressing roller and the heating member. By the heat and pressure in the pressing region, the toner is fixed to the sheet. In addition, the fixing device is often configured to be able to be pulled out from a main body of an image forming apparatus in view of workability at the time of removal of a jammed sheet or maintenance and servicing activity.

In the meantime, the fixing device enables release of the pressing by the pressing mechanism for the purpose of reduction of wrinkles in an envelope or a thin sheet. In addition, in recent years, from a request for energy saving, there is also a fixing device that is capable of setting an intermediate pressure state in which a predetermined pressing force is applied in advance in order to reduce a heating time, and thus a function of adjusting the pressing force is necessary. Accordingly, there may be a case in which a pressing mechanism is configured to convert a rotational force transmitted from a motor or the like, to the pressing force. In this case, in order to release the pressing, there is a need to remove the pressing force by a rotational force in an opposite direction to that at the time of the pressing. However, if the fixing device is pulled out from the main body of the image forming apparatus before the pressing is released, the sheet is hardly removed. The fixing device is also pulled out before the release of pressing is detected, and thus the image forming apparatus determines this pullout as an error and then issues a service call.

In addition, in recent years, a deceleration ratio of the rotational force is prone to be set at a higher value in view of the fact that a high load is applied, and it takes long time to release the pressing. Therefore, there is a high possibility that the fixing device is pulled out from the main body of the image forming apparatus before the pressing is released.

Conventionally, there is known a technique of bringing the fixing device into a pressing state or a pressing release state in synchronism with attachment or detachment of the fixing device to or from the main body of the image forming apparatus. For example, there is a technique in which a locking member and a cam are integrated with a lever, and when the lever is pushed down, the locking member engages with a notch of the main body of the image forming apparatus, and at the same time, the cam brings a pressing roller into the pressing state.

However, this technique is configured to manually actuate the locking member and the cam, and thus cannot be applied to the pressing mechanism that converts the rotational force transmitted from the motor to the pressing force.

SUMMARY

In accordance with an aspect of the present disclosure, a fixing device includes a heating member, a pressing member, a pressing mechanism and a locking mechanism. The heating member is rotatable. The pressing roller is configured to come into contact with the heating member. The pressing mechanism is configured to convert a rotational force transmitted from a drive source to a pressing force of pressing the pressing roller against the heating member and to form a pressing region between the pressing roller and the heating member. A sheet is conveyed through the pressing region. The locking mechanism is configured to be engaged with an image forming apparatus main body linked with a pressing operation of applying the pressing force to the pressing roller and to be disengaged from the image forming apparatus main body linked with completion of a pressing release operation of removing the pressing force.

In accordance with an aspect of the present disclosure, an image forming apparatus includes an image forming unit, the fixing device and a hole. The image forming unit is configured to form a toner image on the sheet. The fixing device is configured to fix the toner image to the sheet. With the hole, the locking lever is to be engaged.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus and a fixing device of the present disclosure will be described with reference to the drawings.

Figure 1:
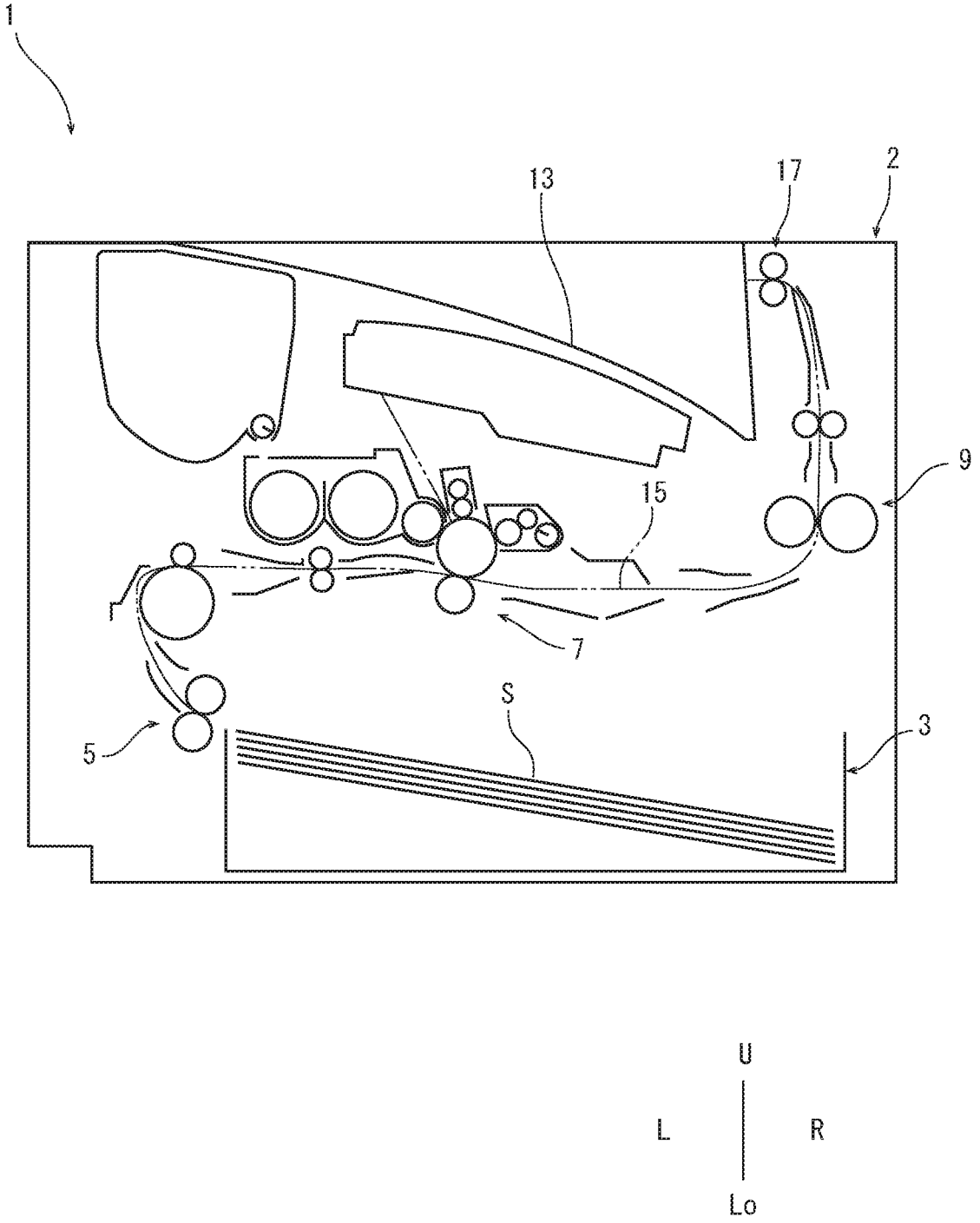
FIG. 1 is a front view schematically showing an inner structure of a printer according to an embodiment of the present disclosure.

With reference to FIG. 1, an entire structure of a printer 1 as an image forming apparatus will be described. FIG. 1 is a front view schematically showing an inner structure of the printer 1. In the following description, a near side (a front side) of a paper surface of FIG. 1 is defined to a front side of the printer 1, and a left-and-right direction is defined based on a direction in which the printer 1 is viewed from the front side. In each figure, U, Lo, L, R, Fr and Rr respectively refer to an upper side, a lower side, a left side, a right side, a front side and a rear side.

An apparatus main body 2 (an image forming apparatus main body) of the printer 1 is provided with: a sheet feeding cartridge 3 in which a sheet S is stored; a sheet feeding device 5 configured to feed out the sheet S from the sheet feeding cartridge 3; an image forming unit 7 configured to form a toner image on the sheet S; a fixing device 9 configured to fix the toner image to the sheet S; a sheet ejecting device 17 configured to eject the sheet S to which the toner image is fixed; and an ejected sheet tray 13 on which the ejected sheet S is stacked. Further, in the apparatus main body 2, a conveying path 15 for the sheet S is formed from the sheet feeding device 5 towards the sheet ejecting device 17 via the image forming unit 7 and the fixing device 9.

The sheet S fed from the sheet feeding cartridge 3 by the sheet feeding device 5 is conveyed to the image forming unit 7 along the conveying path 15, and a full-color toner image is formed on the sheet S. The sheet S is conveyed to the fixing device 9 along the conveying path 15, and the toner image is then fixed to the sheet S at the fixing device 9. The sheet S to which the toner image is fixed is ejected from the sheet ejecting device 17 to the ejected sheet tray 13.

Figure 2:
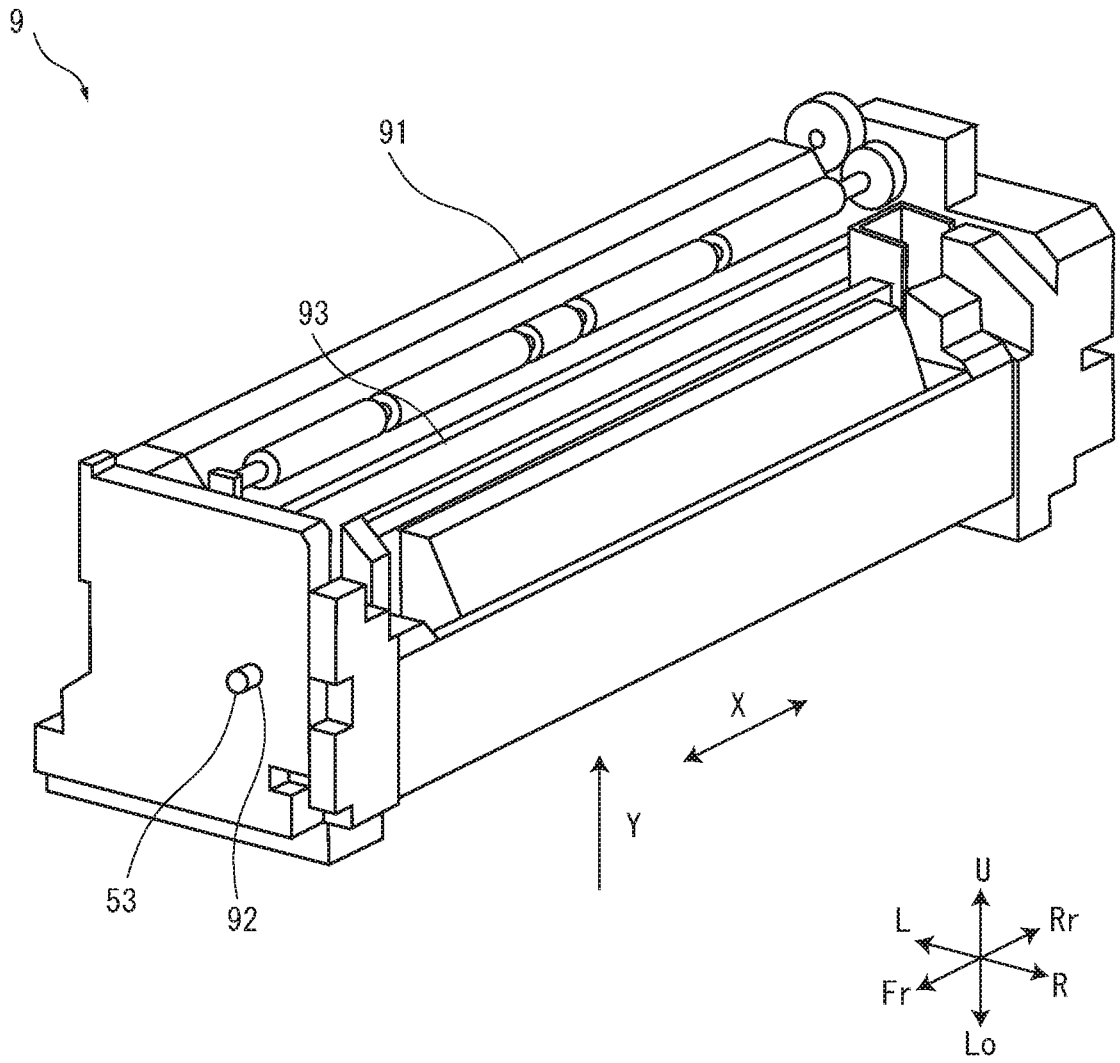
FIG. 2 is a perspective view showing an appearance of a casing of a fixing device according to the embodiment of the present disclosure.
Figure 3:
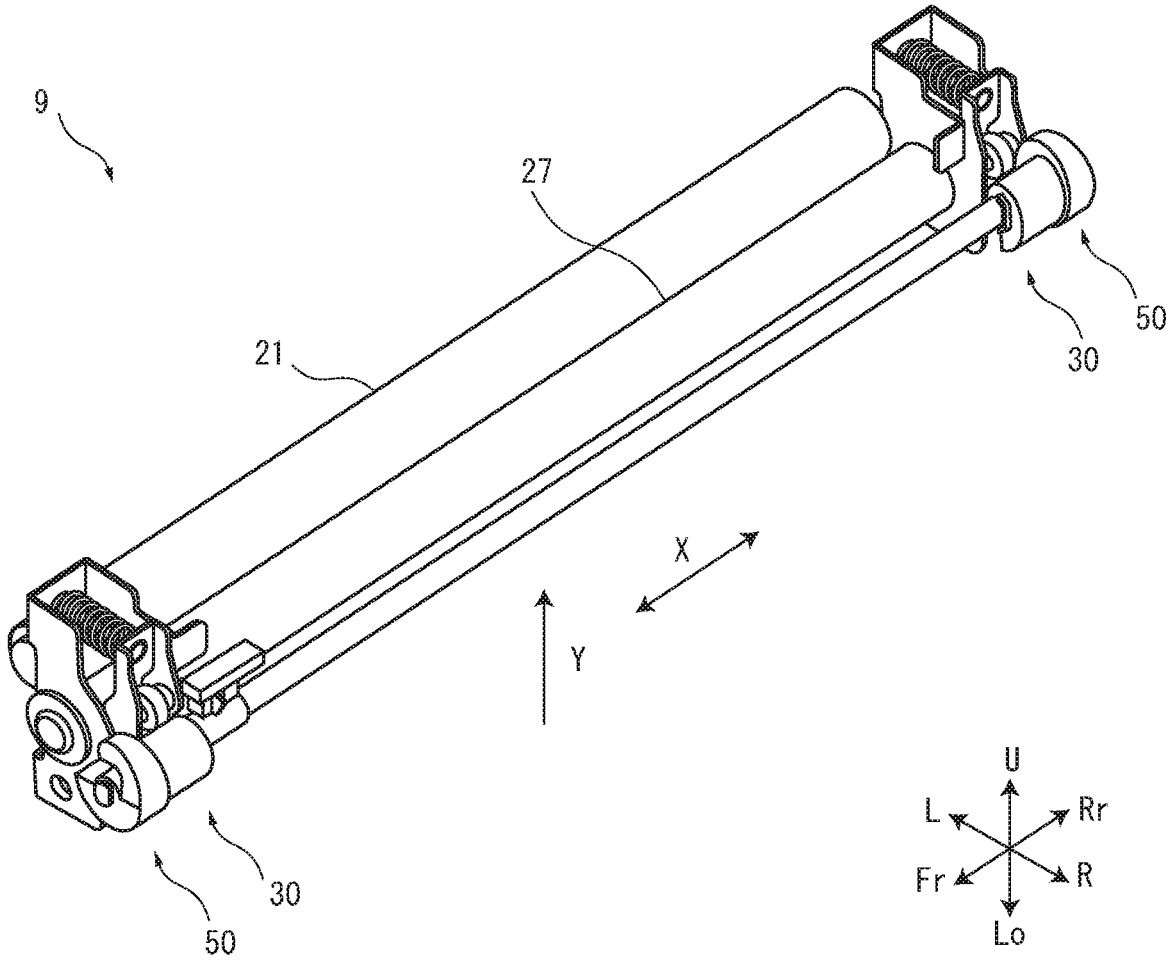
FIG. 3 is a perspective view showing the fixing device according to the embodiment of the present disclosure.
Figure 4:
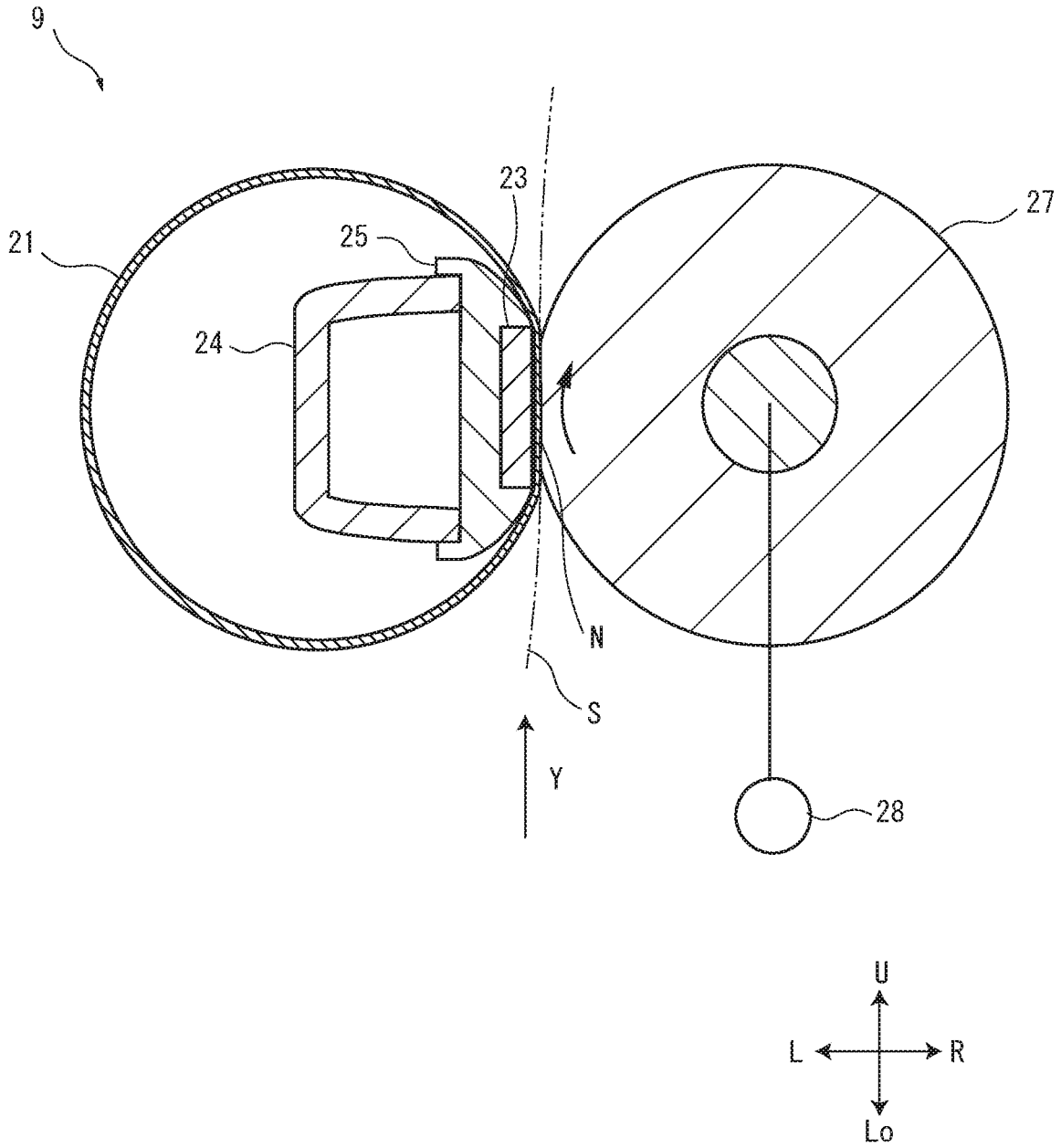
FIG. 4 is a sectional view showing the fixing device according to the embodiment of the present disclosure.
Figure 5:
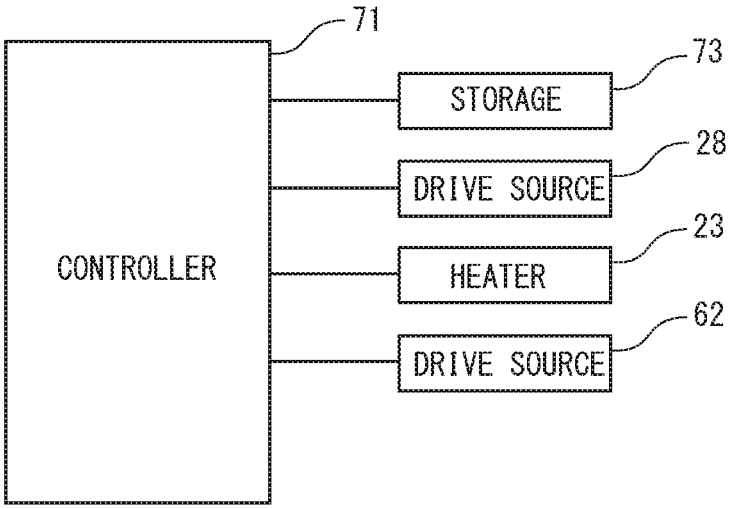
FIG. 5 is a block diagram showing an electrical configuration of the fixing device according to the embodiment of the present disclosure.
Figure 6:
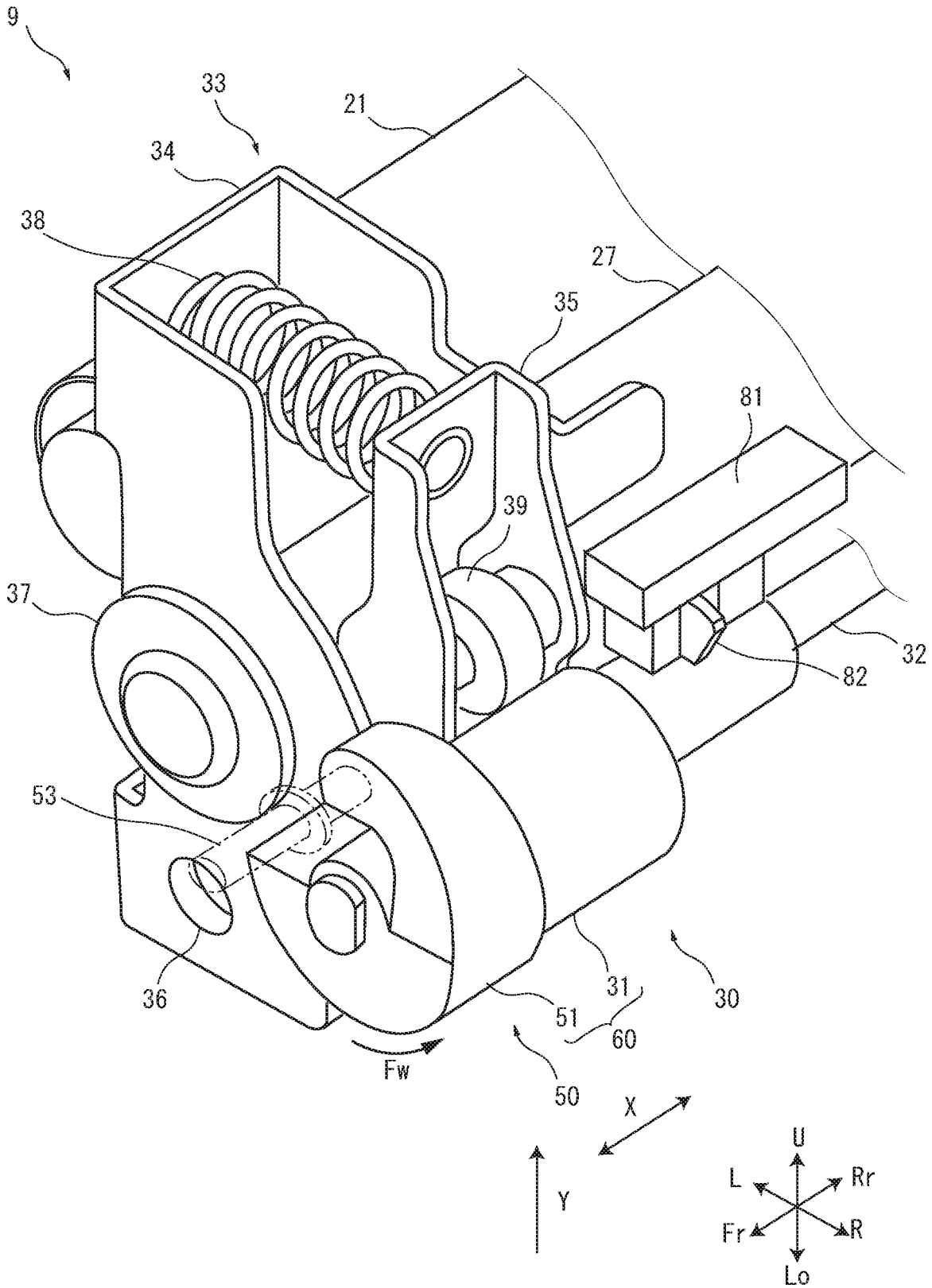
FIG. 6 is a perspective view showing a pressing mechanism and a locking mechanism according to the embodiment of the present disclosure.

Next, with reference to FIG. 2 to FIG. 6, a configuration of the fixing device 9 will be described. FIG. 2 is a perspective view showing an appearance of a casing 91 of the fixing device 9. FIG. 3 is a perspective view of the fixing device 9. FIG. 4 is a sectional view of the fixing device 9. FIG. 5 is a block diagram showing an electrical configuration of the fixing device 9. FIG. 6 is a perspective view of a pressing mechanism 30 and a locking mechanism 50.

The fixing device 9 is housed in the casing 91 formed in an approximately rectangular parallelepiped shape as shown in FIG. 2. The sheet S conveyed from the image forming unit 7 is carried to an inside of the casing 91 through an opening (not shown) formed on a bottom face of the casing 91. The sheet S to which a toner is fixed by the fixing device 9 is carried to an outside from the inside of the casing 91 through an opening 93 formed on atop face of the casing 91.

As shown in FIG. 3 and FIG. 4, the fixing device 9 includes: a rotatable fixing belt 21 (an example of a heating member); a heater 23 configured to heat the fixing belt 21; a holder 25 configured to hold the heater 23; and a pressure roller 27 configured to come into contact with the fixing belt 21.

The present embodiment shows an example in which the fixing device 9 is disposed in a posture in which the pressing roller 27 is arranged on the right side of the fixing belt 21. However, the fixing device 9 may be disposed in any posture. In the following description, "an axial direction X" shows an axial direction (the front-and-rear direction) of the pressing roller 27.

The fixing belt 21 is a cylindrical belt whose longitudinal direction is along the axial direction X, and has a predetermined inner diameter and a width longer than a width of the sheet S. The fixing belt 21 is formed of a material having flexibility, and has: a base layer; an elastic layer provided on an outer circumferential face of the base later; and a release layer provided on an outer circumferential face of the elastic layer. The base layer is formed of a metal such as a stainless steel or a nickel alloy. The elastic layer is formed of a silicone rubber or the like. The release layer is formed of a PFA tube or the like. There may also be a case in which a sliding layer is formed on an inner circumferential face of the base layer. The sliding layer is formed of polyimide-amide or PTFE or the like.

A stay 24 is penetrated through a hollow space of the fixing belt 21, and both ends of the stay 24 are fixed to the casing 91. The stay 24 is formed of a metal such as a stainless steel or an aluminum alloy. The fixing belt 21 is supported by an arc-shaped belt guide (not shown) supported by the stay 24, and is then rotatable around the belt guide.

The heater 23 is a surface heater, for example, and is formed in an approximately rectangular plate shape whose longitudinal direction is along the axial direction X. The heater 23 includes a base, a heat insulation layer and a heating contact part, and they are laminated in the order of the base, the heat insulation layer and the heating contact part.

The holder 25 is a member having almost the same length as that of the fixing belt 21, and is fixed to the stay 24. The holder 25 is formed of a heat-resistant resin such as a liquid crystal polymer, for example. The heater 23 is held by the holder 25 at a position opposite to the pressing roller 27 such that the heating contact part is exposed. The holder 25 holds the heater 23 such that the heating contact part of the heater 23 comes into contact with an inner circumferential face of the fixing belt 21.

The pressing roller 27 includes: a core metal; an elastic layer provided on an outer circumferential face of the core metal; and a release layer provided on an outer circumferential face of the elastic layer. The elastic layer is formed of a silicon rubber or the like. The release layer is formed of a PFA tube or the like. The pressing roller 27 is supported so as to be pressed against the heater 23 via the fixing belt 21. That is, the fixing belt 21 is put between the pressing roller 27 and the heater 23, and a pressing region N is formed between the pressing roller 27 and the fixing belt 21. The pressing roller 27 is driven by a drive source 28 such as a motor.

A fixing operation of the fixing device 9 having the above configuration will be described. When the pressing roller 27 is driven to be rotated, the fixing belt 21 is driven to be rotated in an opposite direction to the rotation direction of the pressing roller 27, and the inner circumferential face of the fixing belt 21 then slides with respect to the heating contact part of the heater 23. When electric power is supplied to the heater 23, the fixing belt 21 is heated. After a temperature of the fixing belt 21 increases to a predetermined temperature, the sheet S to which the toner is transferred is conveyed to the pressing region N. In the pressing region N, the sheet S is put between the fixing belt 21 and the pressing roller 27, and is then conveyed in a predetermined conveyance direction Y. At this time, the toner is heated and pressed by the fixing belt 21, and the toner is then fixed to the sheet S. The sheet to which the toner is fixed is separated from the fixing belt 21, and is then conveyed along the conveying path 15.

As shown in FIG. 5, the printer 1 includes a controller 71 and a storage 73. To the controller 71, the drive source 28, the heater 23 and a drive source 62 are connected. The controller 71 is an arithmetic unit such as CPU. The storage 73 is a storage device such as ROM or RAM. The controller 71 controls each part of the fixing device 9 by using a control program or control data that are stored in the storage 73.

Figure 11:
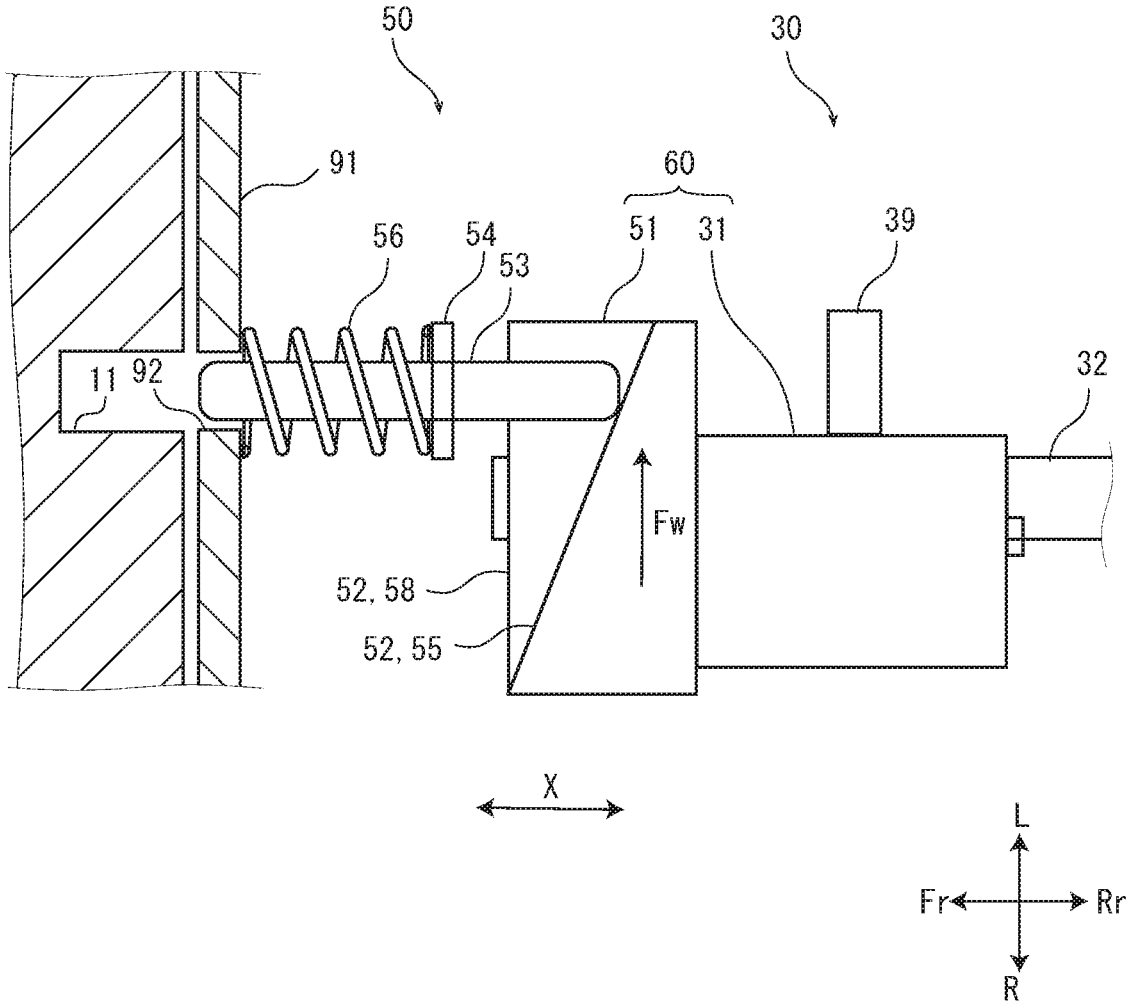
FIG. 11 is a plan view showing the locking mechanism according to the embodiment of the present disclosure.
Figure 12:
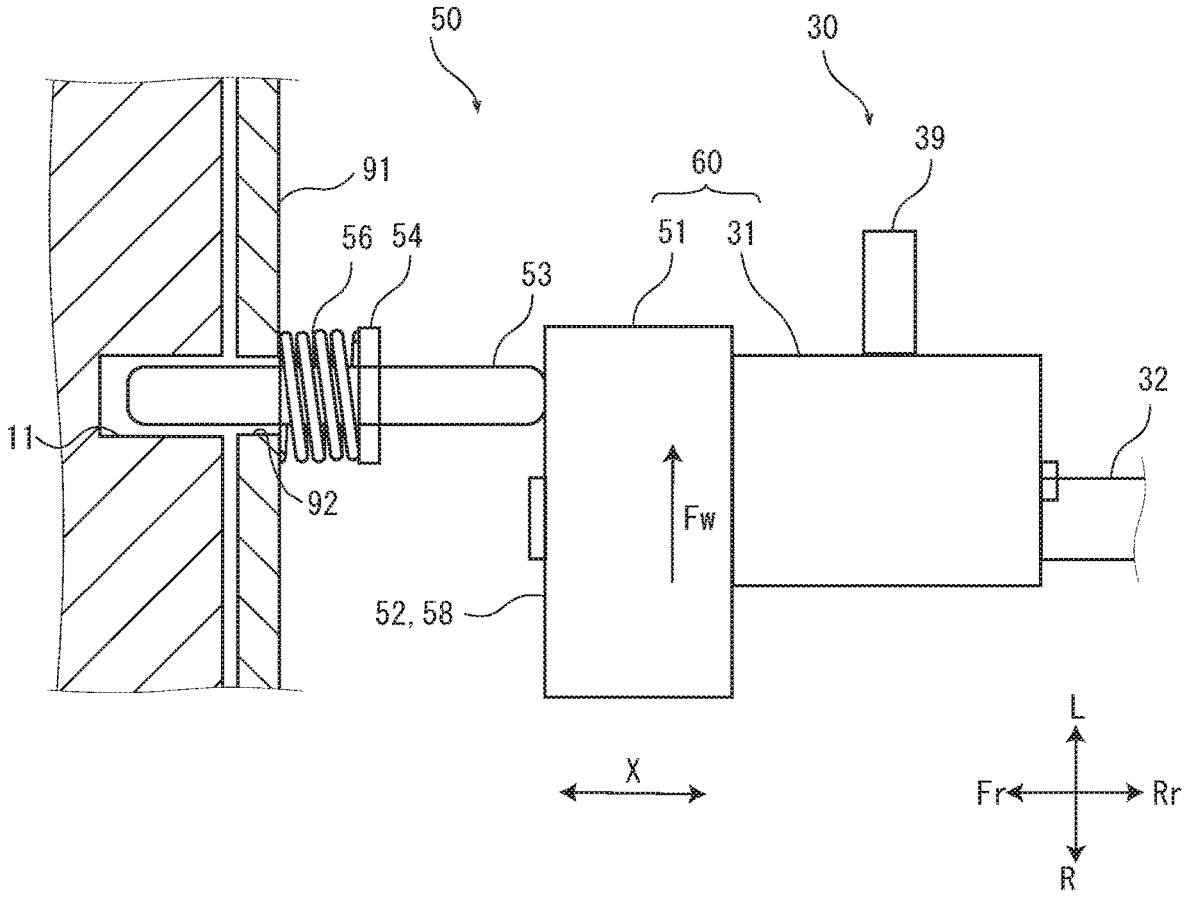
FIG. 12 is a plan view showing the locking mechanism according to the embodiment of the present disclosure.

Next, with reference to FIG. 2, FIG. 3, and FIG. 6 to FIG. 12, the pressing mechanism 30 and the locking mechanism 50 will be described. As shown in FIG. 3, the pressing mechanism 30 and the locking mechanism 50 are disposed at both ends in the front-and-rear direction of the fixing device 9. The pressing mechanisms 30 and the locking mechanisms 50 that are disposed at the ends have an approximately surface-symmetrical structure with respect to a plane whose normal line is along the front-and-rear direction. Then, the pressing mechanism 30 and the locking mechanism 50 that are disposed at the front end of the fixing device 9 will be described hereinafter. FIG. 6 is a perspective view of the pressing mechanism 30 and the locking mechanism 50. FIG. 7 to FIG. 10 are perspective views of the cam part 60. FIG. 11 is a plan view of the locking mechanism 50 in a pressing release state (a locking release state). FIG. 12 is a plan view of the locking mechanism 50 in the pressing state.

The fixing device 9 includes the pressing mechanism 30 and the locking mechanism 50. The pressing mechanism 30 is configured to convert a rotational force transmitted from the drive source 62 such as a motor, to a pressing force of the pressing roller 27 against the fixing belt 21, and to form the pressing region N between the pressing roller 27 and the fixing belt 21. Through the pressing region N, the sheet S is conveyed. The locking mechanism 50 is configured to be engaged with the apparatus main body 2 linked with a pressing operation of applying the pressing force to the pressing roller 27 and to be disengaged from the apparatus main body 2 linked with completion of a pressing release operation of removing the pressing force.

First, a configuration of the pressing mechanism 30 will be described. As shown in FIG. 6, the pressing mechanism 30 includes a rotating shaft 32 and an eccentric cam 31. The rotating shaft 32 is disposed in parallel to the outer circumferential face of the pressing roller 27 at an opposite side to the fixing belt 21 with respect to the pressing roller 27. To the rotating shaft 32, the rotational force is transmitted from the drive source 62. The eccentric cam 31 is fixed to the rotating shaft 32, and comes into contact with a supporting unit 33 that supports the pressing roller 27. The eccentric cam 31 converts the rotational force to the pressing force.

The supporting unit 33 includes a supporting lever 34, a transmitting lever 35, a bearing 37, a spring 38 and a roller 39. The supporting lever 34 is a lever whose longitudinal direction is along the upper-and-lower direction, and has a groove-shaped cross section. A hole 36 is formed in a lower portion of the supporting lever 34. A pin (not shown) provided on the side of the casing 91 is fitted in the hole 36, and the supporting lever 34 is then rotatable around the pin. At a center portion in the upper-and-lower direction of the supporting lever 34, the bearing 37 that supports a shaft of the pressing roller 27 is disposed.

The transmitting lever 35 is a lever whose longitudinal direction is along the upper-and-lower direction, and has a groove-shaped cross section. A lower portion of the transmitting lever 35 is coupled to the lower portion of the supporting lever 34 with a pin (not shown), and the transmitting lever 35 is then rotatable with respect to the supporting lever 34. An upper portion of the transmitting lever 35 and an upper portion of the supporting lever 34 are coupled to each other with the spring 38. At a center portion in the upper-and-lower direction of the transmitting lever 35, the roller 39 is disposed.

The eccentric cam 31 is formed integrally with an end face cam 51 described later, and the cam part 60 is constituted of the eccentric cam 31 and the end face cam 51. The cam part 60 has a hole 61 through which the rotating shaft 32 is inserted, and the cam part 60 is fixed to the rotating shaft 32. The roller 39 comes into sliding contact with the left side of the eccentric cam 31. FIG. 6 shows a state in which the pressing by the pressing mechanism 30 is released (hereinafter, referred to the pressing release state). FIG. 6 to FIG. 9 show the cam part 60 at a posture in the pressing release state. As shown in FIG. 9, an outer circumferential face of the eccentric cam 31 is formed such that a distance between a contact point of the eccentric cam 31 with the roller 39 and a rotational center of the eccentric cam 31 increases (the contact point shifts to the left side) as a rotational angle increases, in a case where the cam part 60 is rotated in a forward rotation direction Fw.

Next, a configuration of the locking mechanism 50 will be described. As shown in FIG. 2 and FIG. 6 to FIG. 12, the locking mechanism 50 includes: the end face cam 51 fixed to the rotating shaft 32; the locking lever 53 configured to come into contact with an end face 52 of the end face cam 51 and to penetrate through a hole 92 provided in the casing 91 that houses the fixing device 9; and a spring 56 (an example of a biasing member) configured to biase the locking lever 53 towards the inside of the casing 91.

Figure 7:
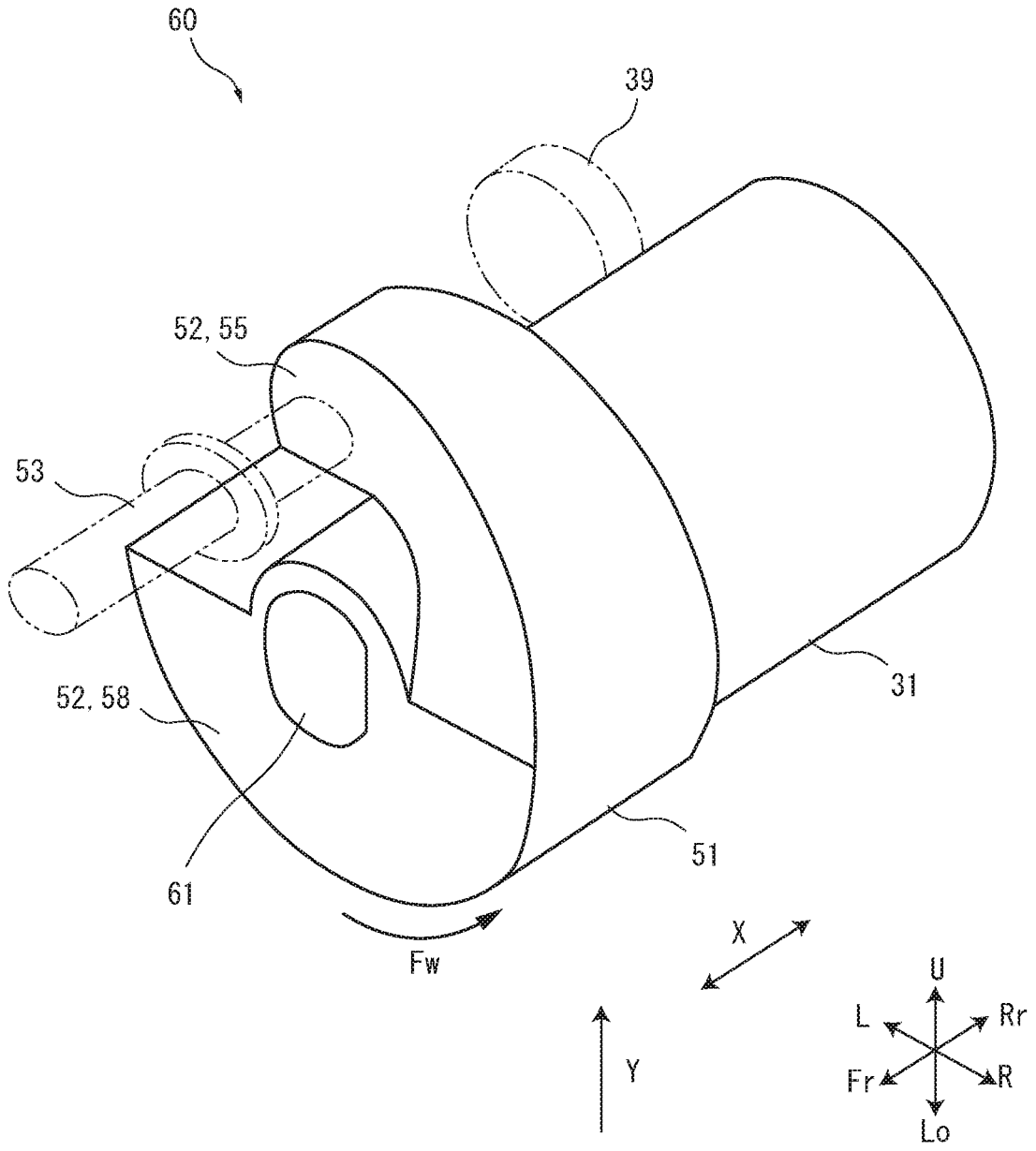
FIG. 7 is a perspective view showing a cam part according to the embodiment of the present disclosure.
Figure 8:
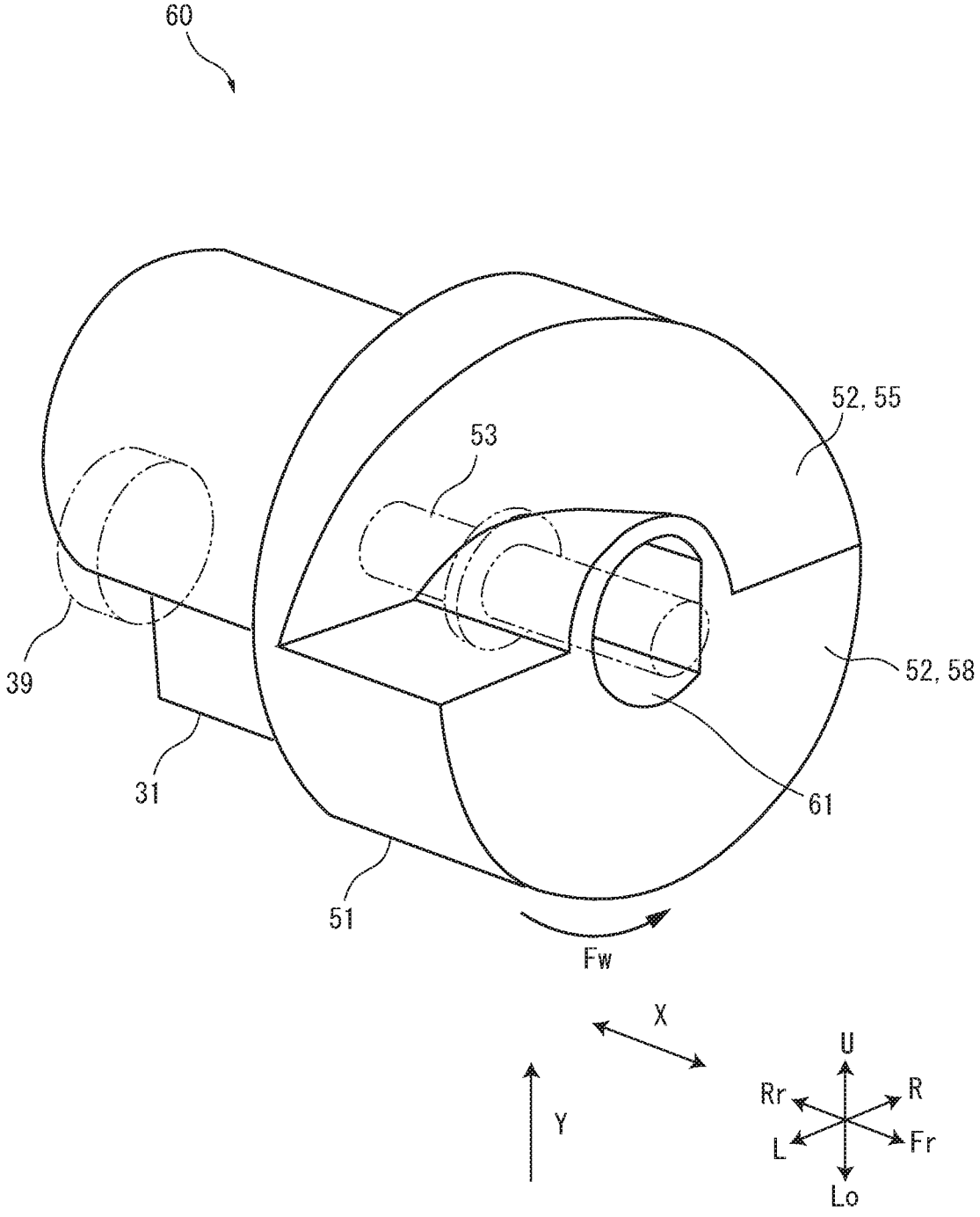
FIG. 8 is a perspective view showing the cam part according to the embodiment of the present disclosure.
Figure 9:
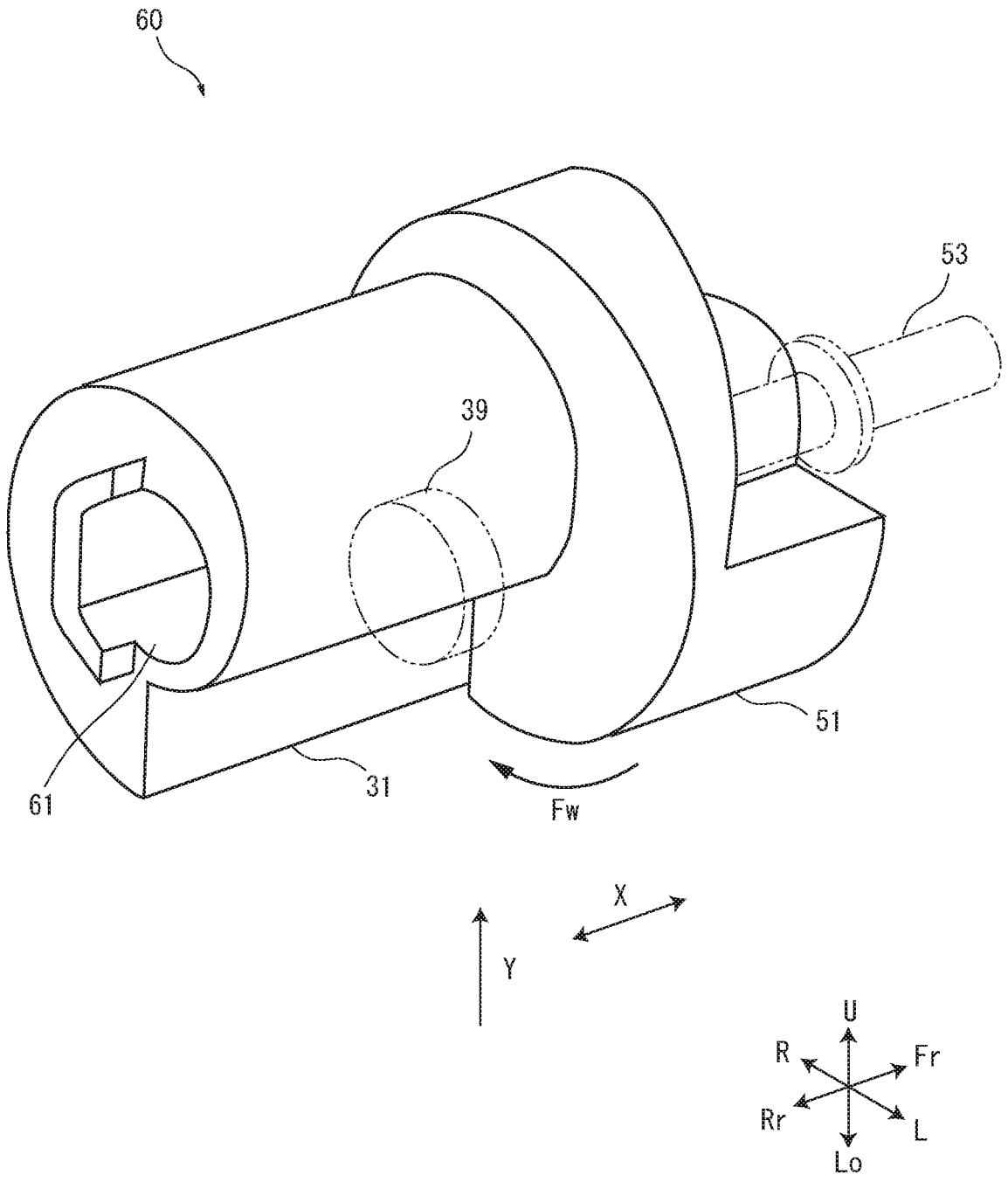
FIG. 9 is a perspective view showing the cam part according to the embodiment of the present disclosure.
Figure 10:
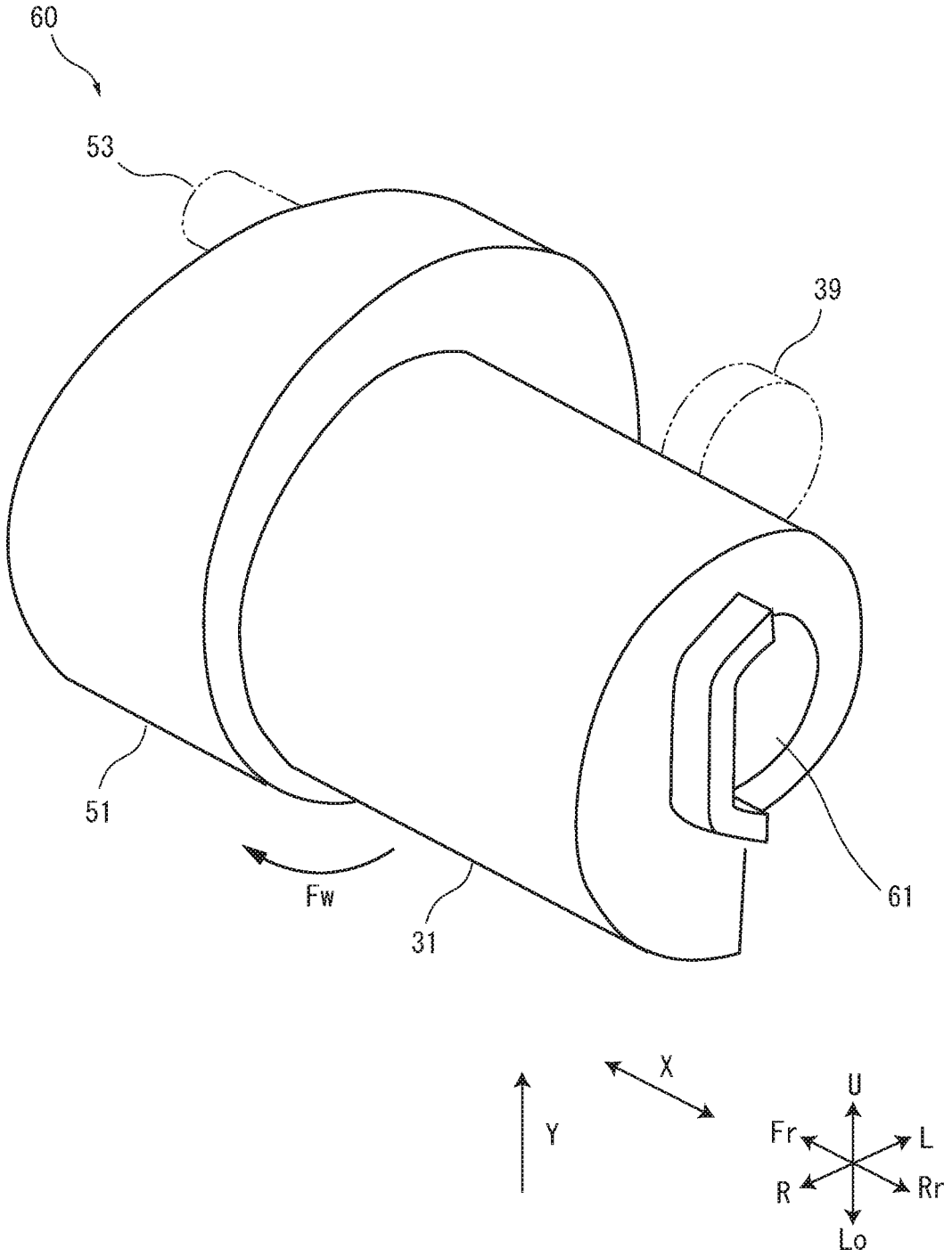
FIG. 10 is a perspective view showing the cam part according to the embodiment of the present disclosure.

As shown in FIG. 7 and FIG. 8, the end face 52 of the end face cam 51 has an inclined part 55 that is formed in a helical shape such that a contact point with a rear end portion of the locking lever 53 shifts forward as the rotational angle increases, in a case where the cam part 60 is rotated in the forward rotation direction Fw from the pressing release state. The inclined part 55 is formed in an area of approximately 180 degrees in the circumferential direction, and the remaining area is a flat part 58 whose normal line is along the axial direction X.

The locking lever 53 is a rod-shaped member whose longitudinal direction is along the axial direction X, and is disposed so as to penetrate through the hole 92 provided in the casing 91. The apparatus main body 2 has a depression 11 at a position corresponding to the hole 92 when the fixing device 9 is attached to the printer 1. Into the depression 11, a front end portion of the locking member 53 is insertable. A flange 54 is formed at almost a center portion in the longitudinal direction of the locking lever 53, and the spring 56 is inserted between a wall face around the hole 92 and the flange 54. Incidentally, in the pressing release state shown in FIG. 6 and FIG. 11, the locking mechanism 50 is in the locking release state in which the locking of the fixing device 9 is released.

With reference to FIG. 6 to FIG. 12, an operation of the pressing mechanism 30 and the locking mechanism 50 will be described. When the controller 71 rotates the cam part 60 in the forward rotation direction Fw, the pressing operation by the pressing mechanism 30 and the locking operation by the locking mechanism 50 are carried out in parallel. When the controller 71 rotates the cam part 60 in a backward rotation direction (an opposite direction to the forward rotation direction Fw), the pressing release operation by the pressing mechanism 30 and the locking release operation by the locking mechanism 50 are carried out in parallel.

First, the pressing operation will be described. When the cam part rotates in the forward rotation direction Fw, the eccentric cam 31 pushes the transmitting lever 35 via the roller 39. Then, a force for pushing the transmitting lever 35 is transmitted to the supporting lever 34 via the spring 38, and the pressing roller 27 is pressed against the fixing belt 21. That is, the rotational force transmitted from the drive source 62 to the rotating shaft 32 is converted to the pressing force of pressing the pressing roller 27 against the fixing belt 21. As a rotational angle increases, an amount of pushing the transmitting lever 35 by the eccentric cam 31 increases, and as a result, the pressing force increases as well.

Next, the locking operation will be described. When the cam part 60 rotates in the forward rotation direction Fw, the end face cam 51 pushes out the locking lever 53 forward in the axial direction against the biasing force of the spring 56. As the rotational angle increases, an amount of pushing the locking lever 53 by the end face cam 51 increases as well. That is, as the amount of pushing the transmitting lever 35 by the eccentric cam 31 increases, the amount of pushing out the locking lever 53 by the end face cam 51 increases as well. As the amount of pushing out the locking lever 53 increases, the locking lever 53 is gradually pushed out from the hole 92 of the casing 91 towards the outside of the casing 91 and then inserted in the depression 11 provided in the apparatus main body 2. When the locking lever 53 is inserted in the depression 11, it becomes impossible to pull the fixing device 9 out from the apparatus main body 2.

As shown in FIG. 12, by rotation of the end face cam 1 by approximately 180 degrees in the forward rotation direction Fw, the rear end portion of the locking lever 53 runs onto the flat part 58, the amount of pushing is maximized, and the locking operation is then completed.

An outer circumferential face of the eccentric cam 31 is configured such that a distance between the contact point of the eccentric cam 31 with the supporting unit 33 and the rotational center of the eccentric cam 31 increases, as the rotational angle in the forward rotation direction Fw further increases after the locking operation is completed. With this configuration, the fixing device 9 enables adjustment of the pressing force in a state in which the locking operation is completed.

Next, the pressing release operation will be described. As a rotational angle in the backward rotation direction of the cam part 60 increases, the distance between the contact point of the eccentric cam 31 with the supporting unit 33 and the rotational center of the eccentric cam 31 decreases, and as a result, the pressing force decreases as well.

Next, the locking release operation will be described. While the rear end portion of the locking lever 53 runs onto the flat part 58 of the end face cam 51, even if the cam part 60 is rotated in the backward rotation direction, the position of the locking lever 53 is not displaced in the front-and-rear direction. If the contact point with the rear end of the locking lever 53 shifts to the inclined part 55, the contact point of the rear end of the locking lever 53 with the inclined part 55 is displaced backward by the biasing of the spring 56, as the rotational angle in the backward rotation direction increases. Therefore, as the rotational angle in the backward rotation direction increases, the amount of pushing the locking lever 53 decreases.

When the posture of the cam part 60 is varied in the state (the pressing release state) shown in FIG. 6 and FIG. 11, the front end portion of the locking lever 53 is completely get out from the depression 11 of the apparatus main body 2. That is, the locking lever 53 is disengaged from the apparatus main body 2 in a case where the distance between the contact point and the rotational center is made equal to or shorter than the distance corresponding to the completion of the pressing release operation, by rotation of the eccentric cam 31 in the pressing release operation. Therefore, according to the present embodiment, it is possible to prevent the fixing device 9 from being pulled out from the apparatus main body 2 before the pressing is released.

Incidentally, the pressing release operation may be controlled to be continued until a detection unit detects that the eccentric cam 31 is rotated at a rotational angle corresponding to the completion of the pressing release operation. Specifically, as shown in FIG. 6, as the detection unit, a photo-interrupter 81 is disposed in the vicinity of the rotating shaft 32, and a shading plate 82 is disposed on the rotating shaft 32. The photo-interrupter 81 includes a light emitting unit and a light receiving unit that oppose to each other. When the right receiving unit detects that the light from the light emitting unit is interrupted by the shading plate 82, the position of the shading plate 82 is determined. In the pressing release state shown in FIG. 6, the shading plate 82 is disposed at a position where the light of the photo-interrupter 81 is interrupted. When the light of the photo-interrupter 81 is interrupted, the controller 71 detects the pressing release state.

Incidentally, the state in which the pressing release operation is completed may be a state in which the pressing roller 27 and the fixing belt 21 do not come into contact with each other; or may be a state in which the pressing roller 27 and the fixing belt 21 come into contact with each other, whereas the pressing force of pressing the pressing roller 27 against the fixing belt 21 is removed; or alternatively, may be a state in which the pressing roller 27 and the fixing belt 21 come into contact with each other and the pressing force still remains to an extent such that a sheet put between the pressing roller 27 and the fixing belt 21 can be easily removed.

In the above embodiment, the eccentric cam 31 and the end face cam 51 are formed as an integrated member. However, the eccentric cam 31 and the end face cam 51 may be formed as separate members.

A fixing roller may be used in place of the fixing belt 21 shown by way of example in the embodiment. Briefly, a heating member may be a member that comes into contact with the pressing roller 27 and is driven to be rotate.

In the embodiment, a surface heater is shown as an example of the heater 23. However, an IH heater or a halogen lamp or the like may be used.

A rotary encoder may be used in place of the photo-interrupter 81 and the shading plate 82 shown by way of example in the embodiment.

Although the present disclosure described the specific embodiment, the present disclosure is not limited to the embodiment. It is to be noted that one skilled in the art can modify the embodiment without departing from the scope and spirit of the present disclosure.

The invention claimed is:

1. A fixing device comprising:

a rotatable heating member;

a pressing roller configured to come into contact with the heating member;

a pressing mechanism configured to convert a rotational force transmitted from a drive source to a pressing force of pressing the pressing roller against the heating member and to form a pressing region between the pressing roller and the heating member, a sheet being conveyed through the pressing region; and a locking mechanism configured to be engaged with an image forming apparatus main body linked with a pressing operation of applying the pressing force to the pressing roller and to be disengaged from the image forming apparatus main body linked with completion of a pressing release operation of removing the pressing force, wherein the pressing mechanism includes:

a rotating shaft disposed in parallel to an outer circumferential face of the pressing roller at an opposite side of the heating member with respect to the pressing roller, the rotational force being transmitted to the rotating shaft from the drive source; and an eccentric cam fixed to the rotating shaft, configured to come into contact with a supporting unit that supports the pressing roller and to convert the rotational force to the pressing force;

the locking mechanism includes:

an end face cam fixed to the rotating shaft;

a locking lever configured to come into contact with an end face of the end face cam and to penetrate through a hole provided in a casing that houses the fixing device; and a biasing member configured to bias the locking lever towards an inside of the casing;

wherein the end face of the end face cam includes an inclined part which is inclined such that by rotation of the eccentric cam in the pressing operation, an amount of pushing the locking lever increases as a distance between a contact point of the eccentric cam with the supporting unit and a rotational center of the eccentric cam increases; and the locking lever is configured to be disengaged from the image forming apparatus main body in a case where by rotation of the eccentric cam in the pressing release operation, the distance between the contact point and the rotational center is made equal to or shorter than a distance corresponding to the completion of the pressing release operation.

2. The fixing device according to claim 1, comprising a detection unit configured to detect that the eccentric cam is positioned at a rotational angle corresponding to the completion of the pressing release operation, wherein the pressing mechanism is configured to continue the pressing release operation until the detection unit detects that the eccentric cam is rotated to the rotational angle in the pressing release operation.

3. The fixing device according to claim 1, wherein the completion of the pressing release operation includes any one of a state in which the pressing roller and the heating member do not come into contact with each other, a state in which the pressing roller and the heating member come into contact with each other, whereas the pressing force of pressing the pressing roller against the heating member is removed, and a state in which the pressing roller and the heating member come into contact with each other and the pressing force still remains to an extent such that a sheet put between the pressing roller and the heating member can be easily removed.

4. The fixing device according to claim 1, wherein the eccentric cam and the end face cam are formed as an integrated member.

5. A image forming apparatus comprising:

an image forming unit configured to form a toner image on the sheet;

the fixing device according to claim 1, configured to fix the toner image to the sheet; and a hole with which the locking lever is to be engaged.

* * * * *